United States Patent [19]

Hunt

[11] 4,395,035

[45] Jul. 26, 1983

[54] AIR SHINGLER

[75] Inventor: Ronald E. Hunt, Georgetown, Tex.

[73] Assignee: International Business Machines Corporation, Armonk, N.Y.

[21] Appl. No.: 219,624

[22] Filed: Dec. 24, 1980

[51] Int. Cl.[3] ..... B65H 3/14

[52] U.S. Cl. ..... 271/97; 271/227; 271/237; 271/242; 226/97

[58] Field of Search ..... 271/97, 98, 227, 242, 271/237, 276, 195; 226/97

[56] References Cited

U.S. PATENT DOCUMENTS

| | | | |
|---|---|---|---|
| 2,883,475 | 4/1959 | Ridler | 226/97 X |
| 3,008,709 | 11/1961 | Buslik . | |
| 3,158,367 | 11/1964 | Tarbuck . | |
| 3,168,308 | 2/1965 | Walton . | |
| 3,345,922 | 10/1967 | Williams | 271/97 X |
| 3,411,829 | 11/1968 | Albright . | |
| 3,504,910 | 4/1970 | Spyropoulos . | |
| 3,511,495 | 5/1970 | Schonfeld . | |
| 3,539,177 | 11/1970 | Schwenk . | |
| 3,774,829 | 11/1973 | Francia | 226/97 |

FOREIGN PATENT DOCUMENTS

| | | | |
|---|---|---|---|
| 55-89143 | 7/1980 | Japan | 271/97 |
| 593995 | 2/1978 | U.S.S.R. | 271/97 |

OTHER PUBLICATIONS

*IBM Technical Disclosure Bulletin,* vol. 19, No. 2, Jul. 1976, p. 441, "Air Jet Sheet Separator", D. F. Manning and J. H. Student.

*IBM Technical Disclosure Bulletin,* vol. 6, No. 2, Jul. 1963, pp. 32 and 33, "Document Feeder and Separator", T. H. Anderson and J. C. Baker.

*Primary Examiner*—Richard A. Schacher

*Attorney, Agent, or Firm*—Andrea P. Bryant

[57] ABSTRACT

There is disclosed apparatus for implementing a technique of shingling a stack (10) of cut sheets using fluid jets. Air (34), or other fluid under pressure, travels through a drum having exit holes arranged about its periphery. The passage of the air causes the drum (30) to self-propel. As each fluid jet contacts the uppermost sheets in the stack, a roll-wave is created. Continued rotation of the drum causes a fluid jet to describe a linear path relative to the stack surface.

8 Claims, 4 Drawing Figures

AIR SHINGLER

DESCRIPTION

Background of the Invention

1. Field of the Invention

The present invention relates to sheet handling, more particularly it relates to separating the edges of the uppermost sheets in the stack so that they may be fed to any desired operating station.

2. Description of the Prior Art

Air, or other fluid, under positive and negative pressure have been used in many prior art configurations for separating flexible sheets.

For example, U.S. Pat. No. 3,511,495 teaches manipulating documents in a stack through the use of air jets in order to avoid wear or damage to the documents. It has the further advantage of having a minimum of moving parts. The invention described therein includes a feeder jets means which is selectively energized and operated to apply a force to the upper surface of the topmost document in the separator chamber. The separator chamber also has air entering the sides under pressure which air acts to fluff the documents and causes their separation one from another.

U.S. Pat. No. 3,539,177 discloses a delivery system for cloth which system includes pickup means to deliver one by one the topmost piece of cloth. The pickup means includes directing at least one blast of air toward the topmost piece of cloth in the direction opposite of the ultimate feed direction. A baffle is provided opposite the air jets so as to cause turbulance in the air as it bounces around thereby ruffling the topmost sheets so as to encourage separation from the next adjacent sheet.

U.S. Pat. No. 3,504,910 teaches a singulator means for documents which, inter alia, minimizes friction between a card being conveyed and the next card in the stack by directing a second jet of air against the card being conveyed by a first jet of air on the side of the card opposite to the side exposed to the outputs from a self-biased fluid amplifier. Air is output from the fluid amplifier and impinges on the top card of the stack at such an angle with such force that the card is caused to move laterally along the conveying surface.

U.S. Pat. No. 3,168,308 discloses directing a stream of air or suitable gas to flow over the face of a sheet member so that the sheet member defines a boundary of the air stream and thereafter changing the air stream so as to lift the sheet member by entraining it in the air stream. The air stream is directed to flow over and generally in parallel with the face of the sheet member and then the air stream path is changed and causes the topmost sheet member to leave the stack. Deviation may occur through rotation of the air outlet so as to direct air in the path inclined to the stack.

U.S. Pat. No. 3,411,829 features a separator device which directs a vertical jet of air onto the top item of the stack and when the stack is moved sufficiently close to the air jet source static pressure is instantaneously converted into radial velocity pressure and the top item is snapped upward from the remaining items in the stack.

U.S. Pat. No. 3,158,367 suggests the use of positive air pressure blowing over the topmost sheet in a stack which flow creates a low pressure area above the sheet so that the topmost sheet rises to adhere to a head from which the air stream emanates.

The article in the IBM Technical Disclosure Bulletin Vol. 19, No. 1, July 1976, page 441, discloses directing a plurality of positive pressure air jets along the surface of a topmost sheet to product low pressure above the sheet. The leading edge of the top sheet is thereby lifted. That edge can then be pinched against a rotating member for withdrawal from the stack.

The document feeder and separator described in IBM *Technical Disclosure Bulletin* Vol. 6, No. 2, July 1963, page 32, includes both positive and negative air pressure for feeding and transporting documents without smudging the printing on the documents and while vacuum is used primarily for picking the documents, the air under pressure is conducted by a tube to assist in the separation of the topmost document in the stack from the stack of documents.

Not one of the above reference takes advantage of the roll-wave generation phenomenon described in U.S. Pat. No. 3,008,709. In that patent free-rolling members in contact with the stack cause a wave-like depression in the stack which travels through the stack to the edges thereof to thereby shingle the documents.

The present invention is an advance over the prior art while maintaining some of the advantages of using air pressure, positive or negative, to separate sheets in that there are few moving parts which thereby decreases the cost of the device and further decreases the opportunity for smudging or the like or other damage to occur since only air is in direct contact with the sheet or other document. The present invention includes a plurality of sources of air under pressure. The sources are arranged evenly about the periphery of a drum. The outlet nozzles are tilted at such an angle so that, as the air is emitted, it is at such an angle that the drum holding the nozzles is self-propelling. Air from any given nozzle comes in contact with the top of a stack of sheets, causes a depression. Continued rotation of the drum causes the air stream to move in the direction of feed with the result that the uppermost sheets in a stack are separated at their edges.

It is an object of the present invention to separate the uppermost sheets in a stack of sheets in an improved manner.

More particularly it is an object of the present invention to produce a translating indentation in the uppermost sheets in a stack of such sheets using an air jet whereby the sheets are shingled.

These and other objects and advantages will become clear as the description progresses having reference to the accompanying drawing wherein.

DETAILED DESCRIPTION OF THE PREFERRED EMBODIMENT

Figure 1:
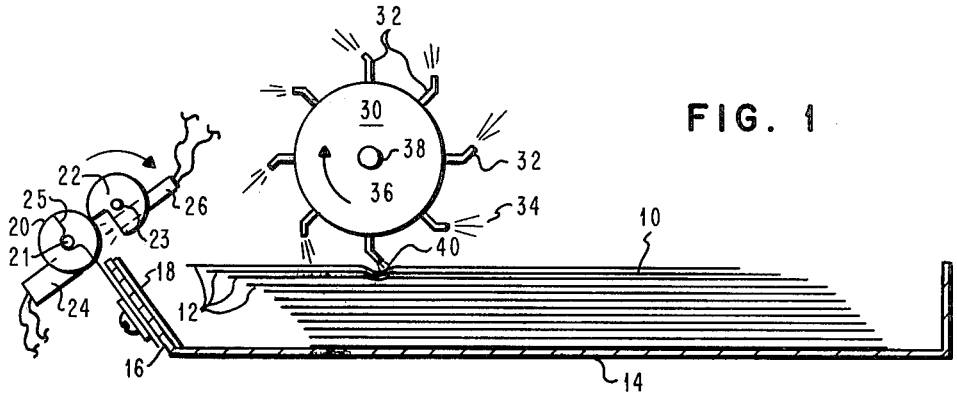
FIG. 1 is a cross-sectional view of sheet feed apparatus embodying the present invention.

Refer now to FIG. 1. A stack 10 of sheets 12 is shown in input hopper 14. Hopper 14 includes an inclined wall 16 in the direction of feed. Passive restraint stop 18 is positioned thereon. A feed nip for grasping a sheet 12 from stack 10 is provided by back up roller 20 and notched rubber roller 22. Adjacent to backup roller 20 is photosensor 24 which detects light from light source 26 positioned adjacent notched rubber roller 22. Leaf spring 25 is provided to bias backup roller 20 toward notched roller 22. Roller 20 is rotatably mounted to stud 21.

Fluid jet emitting drum 30 is provided with air outlet nozzles 32 evenly spaced about its periphery. The nozzles 32 are connected to a common primary source of air under pressure, as will become clear.

Drum 30 with its associated air jets 34 separates sheets 12 in a stack 10 in a manner known as shingling using the roll wave generation phenomenon. That is, the force of an air jet 34 creates an indentation 40 in the uppermost sheets of stack 10. The amount or degree of indentation decreases with the depth of the stack. A given jet 34 first impinges the top of stack and the indentation 40 is created. As drum 30 rotates in the direction of arrow 36, a given jet 34 describes a longitudinal path over the stack causing indentation 40 to travel leftwardly like a wave through the stack. This movement results in the edges of the uppermost sheets 12 becoming shingled leftwardly as shown in FIG. 1. Continued rotation of drum 30 brings these uppermost sheets against passive restraint 18 whence the topmost sheet is caught in the nip formed by rollers 20 and 22.

Figure 2:
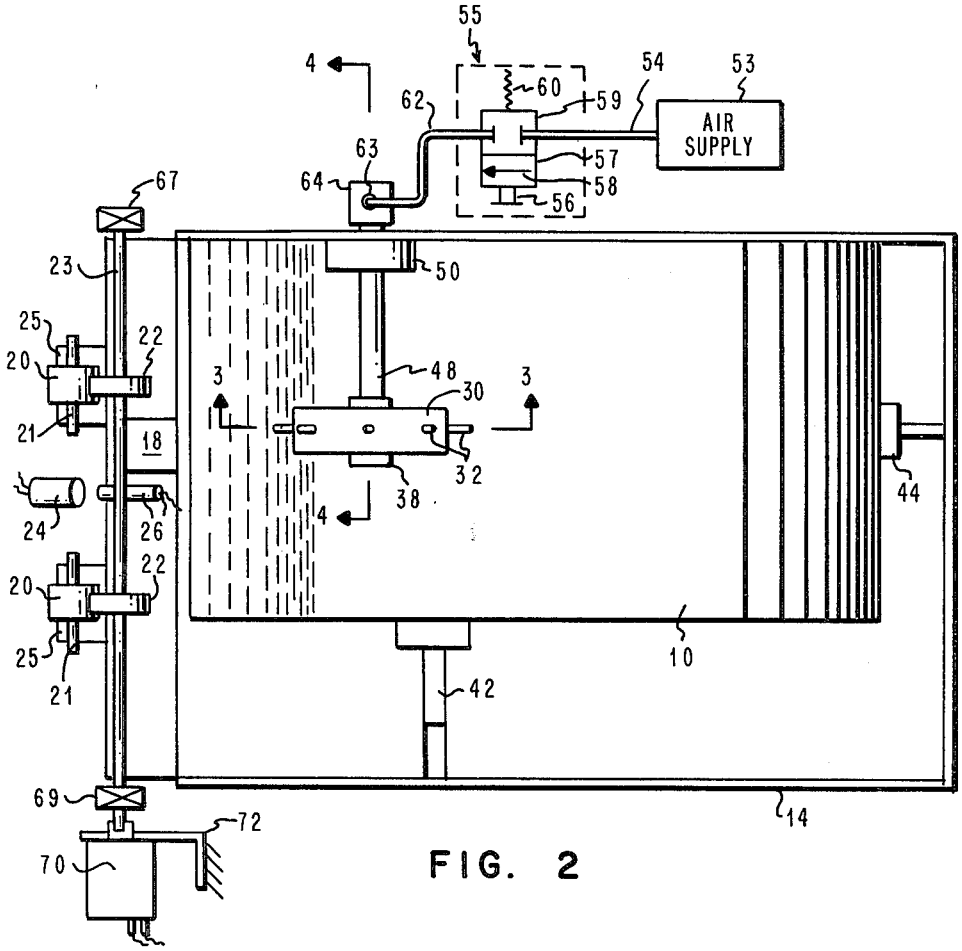
FIG. 2 is a top plan view of the device of FIG. 1.

Refer now to FIG. 2 for a top plan view of the apparatus of FIG. 1. The same reference numerals are used to designate the same parts in all figures. Stack hopper 14 is provided with adjustable stack retaining means 42 and 44 so that various sized sheets may be accommodated in the apparatus. Drum 30, as earlier described, rotates clockwise around hub 38. Hub 38 is connected to fluid conveyor tube 48. This assembly is cantilevered in the side wall of hopper 14. The primary air supply 53 provides air through tube 54 to flow control valve 55. Flow control valve 55, as is well understood by those skilled in the art, is connected to the ultimate using device, a printer or the like, of the sheets in stack 10 so that control valve 55 allows air under pressure from supply 53 to pass through tube 62 and thus through seal housing 64 into drum 30 upon command. That is, solenoid 56 is operatively connected to the using device so that when it is required that a sheet 12 be fed, valve chamber 57 is thrust upwardly. Then air in conduit 54 can flow through valve 55 in the direction of arrow 58. Passage of the leading edge of a sheet 12 is detected by sensor 24 which is connected for deactuating solenoid 56 whereby valve chamber 59 is allowed to return to the air flow position shown. Spring 60 is provided to bias valve 55 into this air flow blocking position.

As can be seen in FIG. 2, two sets of rollers 20 and 22 are provided. Rollers 20 are rotatably mounted on studs 21 about which leaf springs 25 are snapped. Springs 25 are mounted to hopper 14. Rollers 22 are rotatably mounted on rod 23, which rotates in bearings 67 and 69 mounted in the machine frame, not shown. Rod 23 is the output shaft of DC motor 70 mounted in bracket 72. Motor 70 is operatively connected to sensor 24 for initiating clockwise rotation of rollers 22 when sensor 24 indicates that a sheet 12 has its leading edge in the notched part of roller 22. Similarly, a signal from sensor 24 indicating passage of the trailing edge of a given sheet 12 may be used to deactivate motor 70 and thereby cause rotation of rollers 22 to cease.

Figure 3:
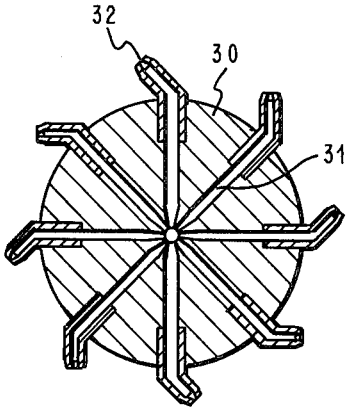
FIG. 3 is a cross-sectional view of the air stream emitting drum 30 of FIG. 1.
Figure 4:
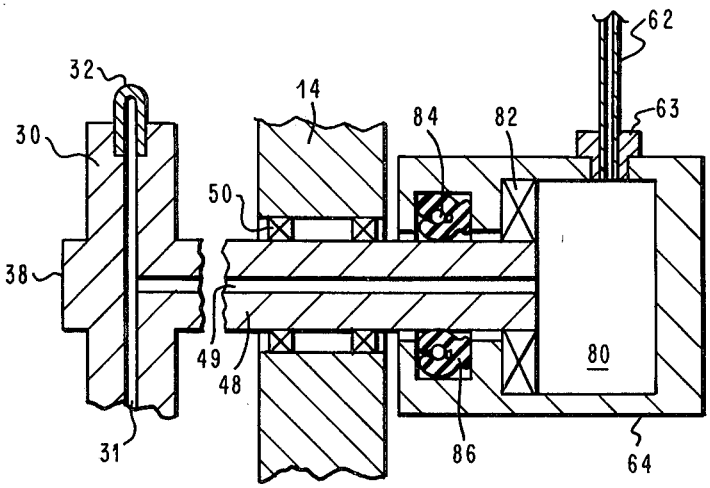
FIG. 4 is a cross-sectional view of the control connection between the air supply and the air emitting drum 30.

FIG. 3 is a cross-sectional view taken along lines 3—3 in FIG. 2 of drum 30. Choked down nozzles 32 are at an angle chosen to provide a radial thrust to direct air jets 34 at the stack 10, as well as a tangential thrust to enable self-propulsion of the entire drum 30 assembly. In FIGS. 3 and 4 air under pressure travels through conduit 49 in tube 48 and conduits 31 in drum 30 to the individual nozzles 32. It will be recalled from the discussion of FIG. 1 that nozzles 32 are positioned at an angle such that the jet of air from a given nozzle hits the stack of sheets and causes depression 40 shown in FIG. 1. A further advantage achieved from such an angle is the self-propulsion into rotation in the direction of arrow 36 of drum 30. Rotation of drum 30 causes an individual jet 34 to contact the stack in a linear way in a leftward direction of FIG. 1 with the result that the indentation 40 travels leftwardly until edges 12 are separated as shown. Continued rotation of drum 30 brings the sheets up to passive restraint means member 18 and one sheet, the uppermost sheet, into the nip formed by rollers 20 and 22 at which time the feed of air under pressure from source 53 ceases. A stack elevator is not shown but any conventional stack elevator may be used to maintain the top of stack 10 at a predetermined height as well understood in the art.

In FIG. 4, a sectional view of the apparatus of FIG. 2 taken along the lines 4—4, the connection from air supply 53 to drum 30 can be better understood. Air under pressure from source 53, as controlled by control valve 55, flows through conduit 62 connected by seal 63 in seal housing 64 to plenum chamber 80. Pressurized air enters chamber 80 which is connected with mounting conveyor tube 48. Mounting tube 48 is rotatably mounted in bearings 50 in the side wall of the input hopper 14 as well as bearing 82 within seal housing 52. Coil spring 84 is provided to maintain the sealing relationship of rubber seal 86 about mounting conveyor tube 48. Air conduit 49 in tube 48 opens into conduits 31 associated with each nozzle 32 in drum 30.

Operation of the Invention

The present invention, as embodied in the apparatus shown in FIGS. 1 through 4, operates to separate at their leading edges, the uppermost sheets 12 of the stack 10 of such sheets in the direction of feed to a printer or other device requiring cut sheets fed seriatim. Upon receipt of a signal from the using device indicating a requirement for feeding a sheet, control valve 55 allows air under pressure from source 53 to pass through chamber 80 through conduits 49 and 31 to nozzles 32. The amount of pressure under which air travels through nozzles 32 is such that drum 30 is self-propelling. Sheets are separated by the roll wave generated in the uppermost sheets by the passing of air jets 34 over the top of the stack. Unlike roll wave generators of the type wherein contact is maintained between the shingler wheel and the stack to be separated, the present air shingler does not require critical spatial adjustments. That is, the distance between drum 30 and the top of stack 10 may be allowed to vary within reasonable limits, the difference in separation therebetween being compensated by air pressure level.

Once a sheet 12 has been grasped in the nip created by rollers 20 and 22, control valve 55 stops the flow of air under pressure therethrough. The shingling action stops immediately. Rotation of drum 30 continues due to inertia.

While the instant invention has been described with reference to the illustrated, preferred embodiment, it is to be understood that many changes in form and detail may be made without parting from the scope of the invention as described in the following claims.

What is claimed is:

1. A method of separating sheets in a stack for feeding seriatim to an operating station including the steps of:
(1) downwardly directing a fluid jet to the topmost sheet such that the jet includes a force component normal to the topmost sheet; and
(2) moving the jet in the feed direction whereby uppermost sheets are shingled.

2. In combination, apparatus for separating documents in a stack comprising:
(1) a source of fluid under pressure;
(2) means for directing at least one jet of fluid under pressure toward the top of the stack;
(3) means for moving the contact point of the jet linearly along the surface of the stack, whereby a roll wave is generated and propagated to the edges of the stack;
(4) nip means for engaging the leading edge of the uppermost sheet; and
(5) means for controlling the flow of fluid under pressure.

3. The apparatus of claim 2 where said means for directing comprises a hollow drum having evenly spaced about its periphery a plurality of nozzles;
(1) the source of fluid under pressure is connected to said hollow drum; and
(2) said hollow drum is rotatably supported adjacent said stack of documents.

4. The apparatus of claims 2 wherein said means for moving the contact point of the jet includes nozzles structured so that fluid is emitted at an acute angle relative to a line perpendicular to the surface of the drum whereby the flow of fluid under pressure causes the drum to rotate.

5. The apparatus of claim 3 wherein said means for moving the contact point of the jet includes nozzle structured so that fluid is emitted at an acute angle relative to a line perpendicular to the surface of the drum, whereby the flow of fluid under pressure causes the drum to rotate.

6. The above apparatus of claims 2 3, 4 or 5 wherein said fluid flow control means includes
(1) a means for detecting when a sheet is engaged in said nip means,
(2) and said fluid flow control means is responsive to said detecting means to block the flow of fluid under pressure.

7. The apparatus of claims 2, 3, 4 or 5 wherein said means for engaging the leading edge of the uppermost sheet in the stack comprises:
(1) a nip formed by a first notched roller;
(2) and a second backup roller, said backup roller being biased toward said notched roller.

8. The apparatus of claim 7 wherein said fluid flow control means includes (1) a means for detecting when a sheet is engaged in said nip means, (2) and said fluid flow control means is responsive to said detecting means to block the flow of fluid under pressure.

* * * * *